US006912931B1

(12) United States Patent
Draur et al.

(10) Patent No.: US 6,912,931 B1
(45) Date of Patent: Jul. 5, 2005

(54) METHOD AND APPARATUS FOR REMOVING A LID FROM A CONTAINER

(75) Inventors: Thomas E. Draur, Johnston, IA (US); Jeffrey S. Dworek, West Des Moines, IA (US); Tracy S. Lemar, West Des Moines, IA (US)

(73) Assignee: Innovating Solutions, Inc., Des Moines, IA (US)

( * ) Notice: Subject to any disclaimer, the term of this patent is extended or adjusted under 35 U.S.C. 154(b) by 91 days.

(21) Appl. No.: 10/108,215

(22) Filed: Mar. 25, 2002

(51) Int. Cl.[7] ..... B67B 7/44
(52) U.S. Cl. ..... 81/3.2; 81/3.29
(58) Field of Search ..... 81/3.2, 3.29, 3.55

(56) References Cited

U.S. PATENT DOCUMENTS

| | | | | |
|---|---|---|---|---|
| 5,255,574 | A * | 10/1993 | Wuerschum | 81/3.2 |
| 5,826,409 | A * | 10/1998 | Slepicka et al. | 81/3.2 |
| 6,257,091 | B1 * | 7/2001 | Cohen et al. | 81/3.2 |
| 6,604,903 | B2 * | 8/2003 | Osborne et al. | 81/3.2 |

* cited by examiner

*Primary Examiner*—James G. Smith
(74) *Attorney, Agent, or Firm*—Brett Trout

(57) ABSTRACT

An opener is provided for removing a lid from a paint can or any other similar type container. The opener has a plurality of tapered bits coupled to a first means for moving the bits toward the lid. The opener is also provided with a second means for moving the bits relative to the container to lift the lid from the container.

19 Claims, 7 Drawing Sheets

METHOD AND APPARATUS FOR REMOVING A LID FROM A CONTAINER

FIELD OF THE INVENTION

The present invention relates generally to a method and apparatus for removing a lid from a container and, more particularly, to a method and apparatus for quickly removing a lid from a paint can which may be damaged or secured by an adhesive.

BACKGROUND OF THE INVENTION

It is generally known in the art to remove a lid from a container, such as a paint can, using a simple steel lever. The user wedges the lever between the container and the lid, and then pivots the lever to force the lid away from the container. While this technique is effective in removing lids from new containers, this technique has several drawbacks.

One drawback associated with prior art can openers is that as the opener lifts one side of a lid, the other side pivots, sealing it into tighter engagement with the container. It would, therefore, be desirable to prevent movement of one portion of the lid toward the container while the opener lifts another portion of the lid. Another drawback associated with this prior art method of removing a lid from a container is the difficulty associated with removing a lid from a damaged container, or from a container in which a product such as paint or adhesive has dried between the container and lid. Although the prior art method may still be effective to remove the lid from such a container, the prior art lever often must be inserted and pivoted, sometimes dozens of times, to lift a damaged lid or to break the adhesive contact and remove the lid from the container.

It is also known in the art to puncture or cut into cans to remove their contents. This prior art method of can opening also has several drawbacks. One drawback is that puncturing or cutting the cans creates sharp edges, which pose a hazard to workers during manipulation and disposal. Another drawback is that puncturing or cutting the cans prevents their reuse. Still another drawback associated with puncturing or cutting cans is that the process is often very messy, contaminating the opener and operator with the contents of the can.

Accordingly, when the container or lid are damaged, or sealed together by paint or other adhesive, the effectiveness of prior art can openers diminishes substantially. Not only does this diminished effectiveness lead to lost time and excessive cost associated with removal of lids, but it can also lead to injury. When dozens or thousands of lids must be removed, the repetitive motion associated with prior art can openers may often lead to carpal tunnel or other repetitive stress injuries.

The difficulties encountered in the prior art discussed hereinabove are substantially eliminated by the present invention.

SUMMARY OF THE INVENTION

In an advantage provided by this invention, a method and apparatus is provided for reducing the time associated with removing lids from containers.

Advantageously, this invention provides a method and apparatus for reducing the occurrence of repetitive stress injury associated with removing lids from containers.

Advantageously, this invention provides a non-destructive method and apparatus for removing lids from containers.

Advantageously, this invention prevents any portion of a lid from moving into tighter engagement with a container when any other portion of the lid is lifted away from the container.

Advantageously, this invention provides a method and apparatus which assists in removing lids from damaged containers.

Advantageously, this invention provides a method and apparatus which aids in the removal of lids sealed to containers by friction, dried paint or other adhesive.

Advantageously, in a preferred example of this invention, an opener for removing a lid from a container is provided, comprising a first bit having a face, first means coupled to the first bit for moving the face of the first bit into contact with the lid, and for moving the first bit relative to the container. The opener also comprises a second bit having a face, and a second means coupled to the second bit for moving the face of the second bit into contact with the lid and for moving the second bit relative to the container.

In the preferred embodiment, the opener comprises a plurality of bits, substantially simultaneously moved into contact with the lid, and means for moving the bits relative to the container so as to remove the lid from the container.

BRIEF DESCRIPTION OF THE DRAWINGS

The invention will now be described by way of example, with reference to the accompanying drawings in which.

DETAILED DESCRIPTION OF THE PREFERRED EMBODIMENT

Figure 1:
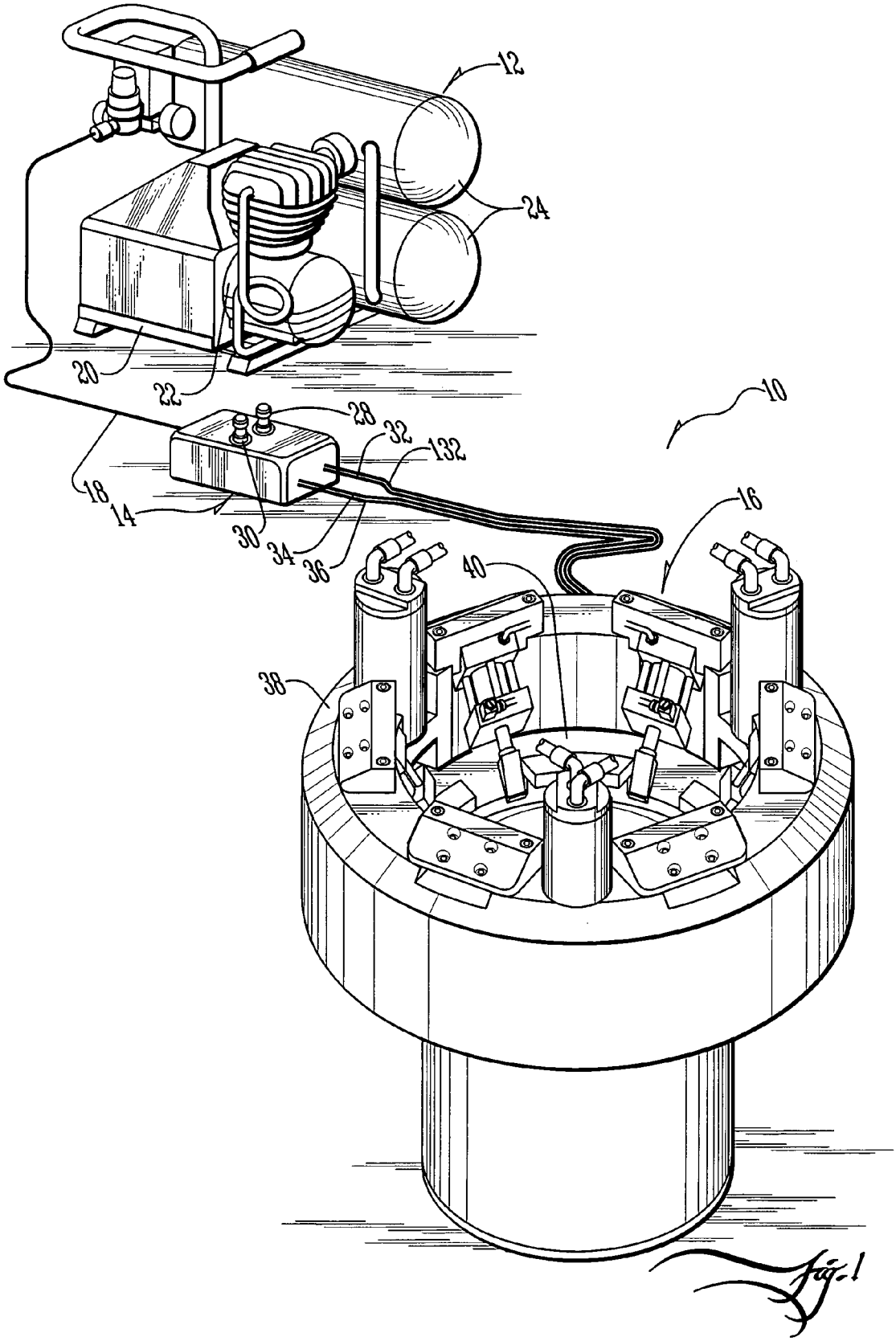
FIG. 1 illustrates a top perspective view of the preferred embodiment of the can opener of the present invention.

The opener of the present invention is shown generally as (10) in FIG. 1. As shown in FIG. 1, the opener (10) comprises a compressor assembly (12), a control box (14), and a bracket assembly (16), coupled to one another with high pressure air lines (18), such as those well known in the art. Although the compressor assembly (12) may be of any suitable type known in the art, in the preferred embodiment, the compressor assembly (12) is an Ultra Air-Pac®, Model T-2 0 compressor, manufactured by Thomas Industries, Inc. of Sheboygan, Wis., which includes a frame (20), coupled to a compressor (22) and an air tank (24). As shown in FIG. 1, the air tank (24) is coupled to the control box (14) by the high pressure line (18).

Figure 2:
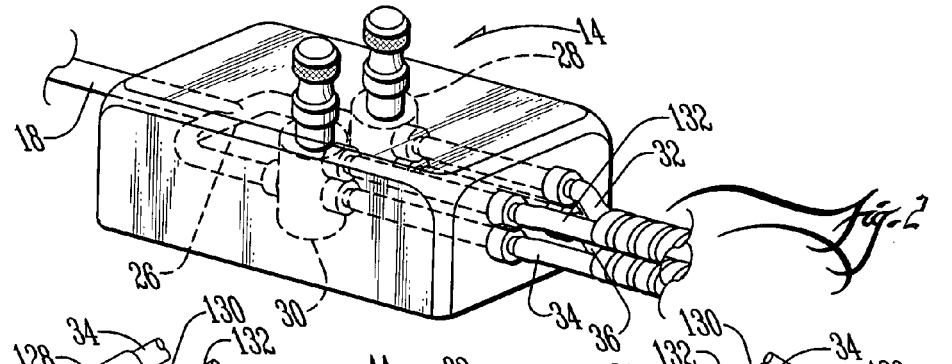
FIG. 2 illustrates a top perspective view in partial phantom of the control box of the opener of FIG. 1.

The control box (14) may be constructed of any suitable valves or control mechanisms known in the art. In the preferred embodiment, the control box (14), as shown in FIG. 2, comprises a "T" line (26), one end of which is coupled to a first valve (28) and the second of which is coupled to a second valve (30). Preferably, the valves (28) and (30) are spring actuated to open when depressed and close when released. A first input line (32) extends from the first valve (28) and a second input line (34) extends from the second valve(30). Similarly, a first exhaust line (36) connects with the first valve (28) and a second exhaust line (132) connects to the second valve (30). As shown in FIG. 2, the lines (32), (34), (36) and (132) exit the control box (14) and are coupled to the bracket assembly (16) in a manner detailed below.

Figure 3:
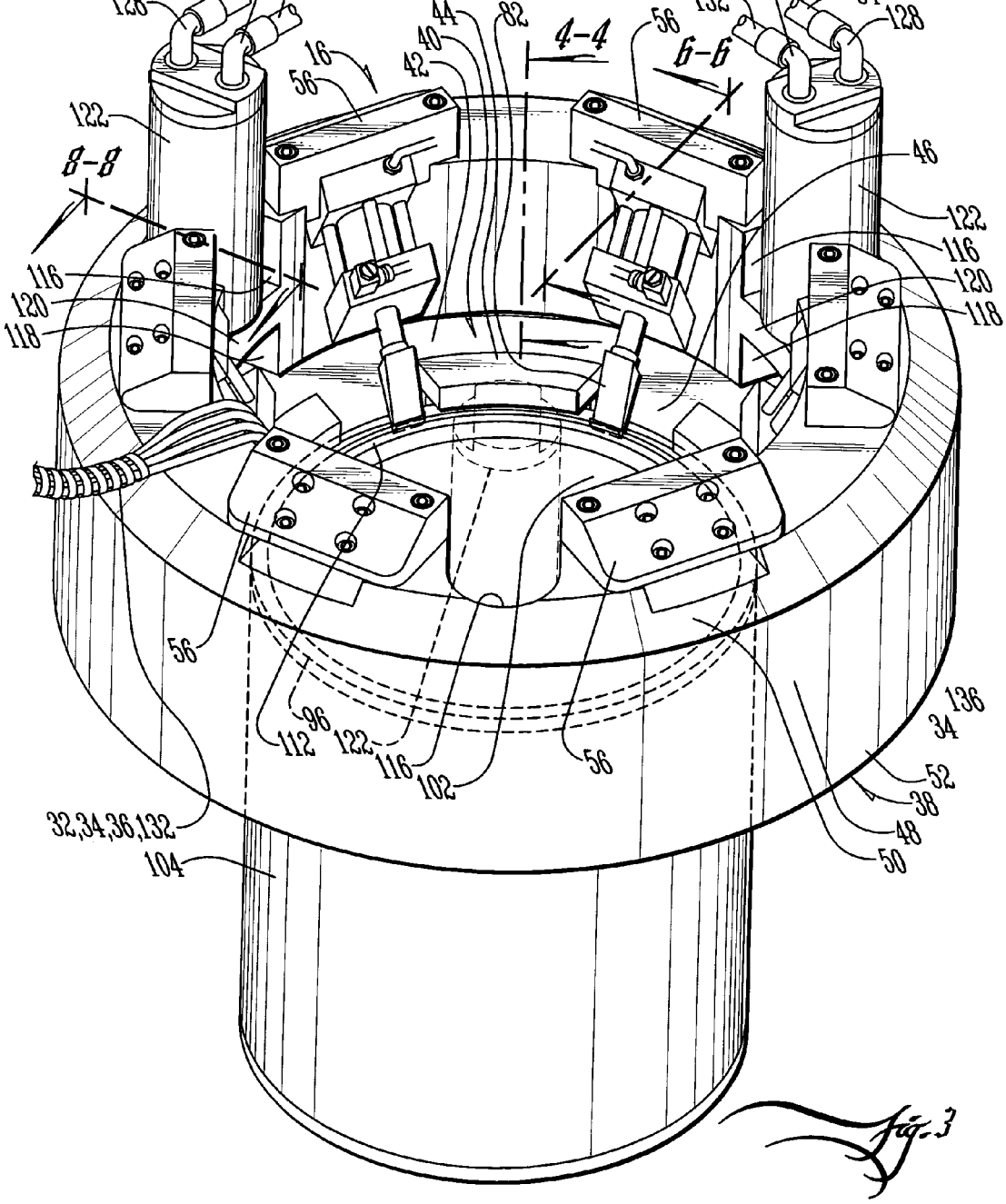
FIG. 3 illustrates a perspective view in partial phantom of the bracket assembly of the opener of FIG. 1, shown coupled to a paint can and lid.

As shown in FIG. 3, the bracket assembly (16) comprises a shoulder assembly (38) and a base plate (40). As shown in FIG. 3, the base plate (40) comprises an annular plate (42), constructed of aluminum, having an exterior diameter of 31.623 centimeters, an interior diameter of 16.828 centimeters, and a thickness of 0.813 centimeters. Integrally formed with the annular plate (42) is a plurality of aluminum shoulders (44), each having a thickness of 1.499 centimeters, extending 2.667 centimeters above the annular plate (42), and 1.727 centimeters toward the interior of the annular plate (42). As shown in FIG. 3, the shoulders (44) are preferably constructed of lengths sufficient to define slots (46), 3.096 centimeters in width, and extending 7.493 centimeters from the edge of the annular plate (42).

Figure 4:
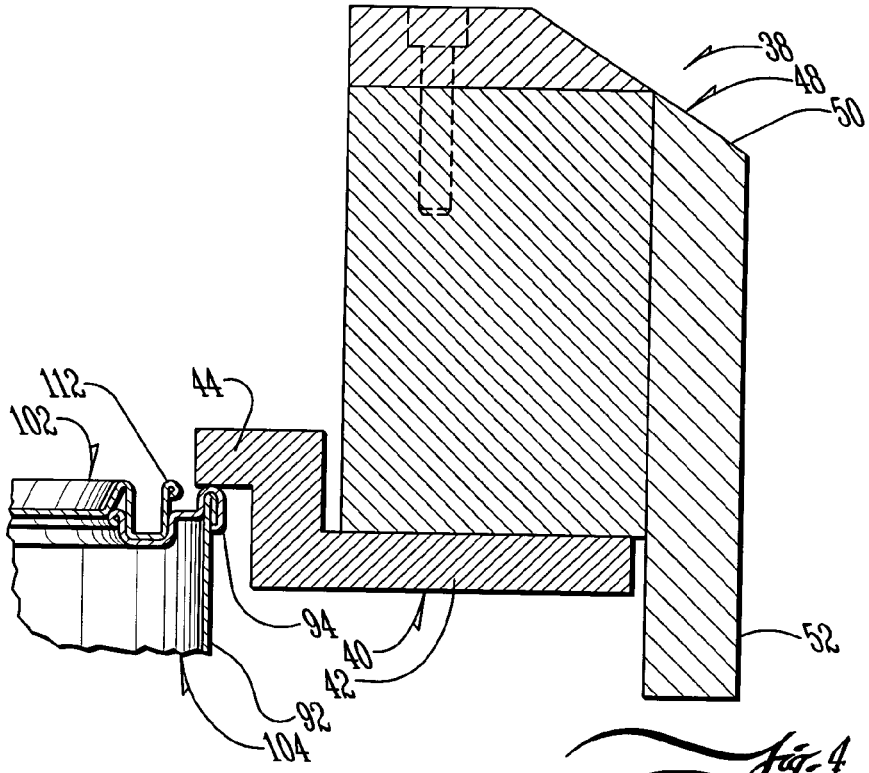
FIG. 4 illustrates a side elevation in cross-section, taken along line 4—4 of FIG. 3.

As shown in FIG. 4, the shoulder assembly (38) comprises a shoulder ring (48) having an inner diameter of 32.156 centimeters, an outer diameter of 34.011 centimeters, and a height of 13.335 centimeters. The shoulder ring (48) may be constructed of any suitable material but, in the preferred embodiment, is constructed of aluminum. As shown in FIG. 4, the shoulder ring (48) is preferably provided with a chamfered corner (50), and a depending lip (52). The depending lip (52) is preferably integrally formed with the shoulder ring (48), depending 4.877 centimeters therefrom, and stair-stepping in from 4.216 centimeters to 3.759 centimeters to 1.6 centimeters. As shown in FIG. 4, the depending lip (52) is preferably designed to define an interior slightly larger than the base plate (40). Although the opener (10) may be constructed of any suitable dimensions, in the preferred embodiment the dimensions are preferably 10% to 1000%, and more preferably 30% to 200% of the dimensions detailed above.

Figure 5:
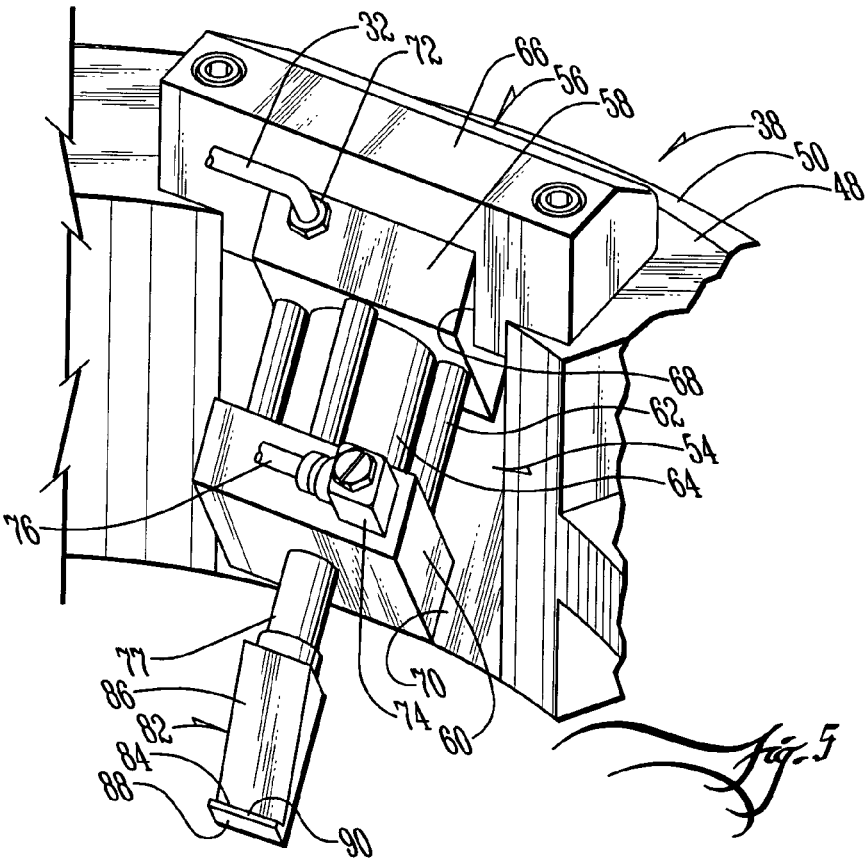
FIG. 5 illustrates a front perspective view of the bit assembly of the opener of FIG. 1, shown secured within a recess provided in the bracket assembly.
Figure 6:
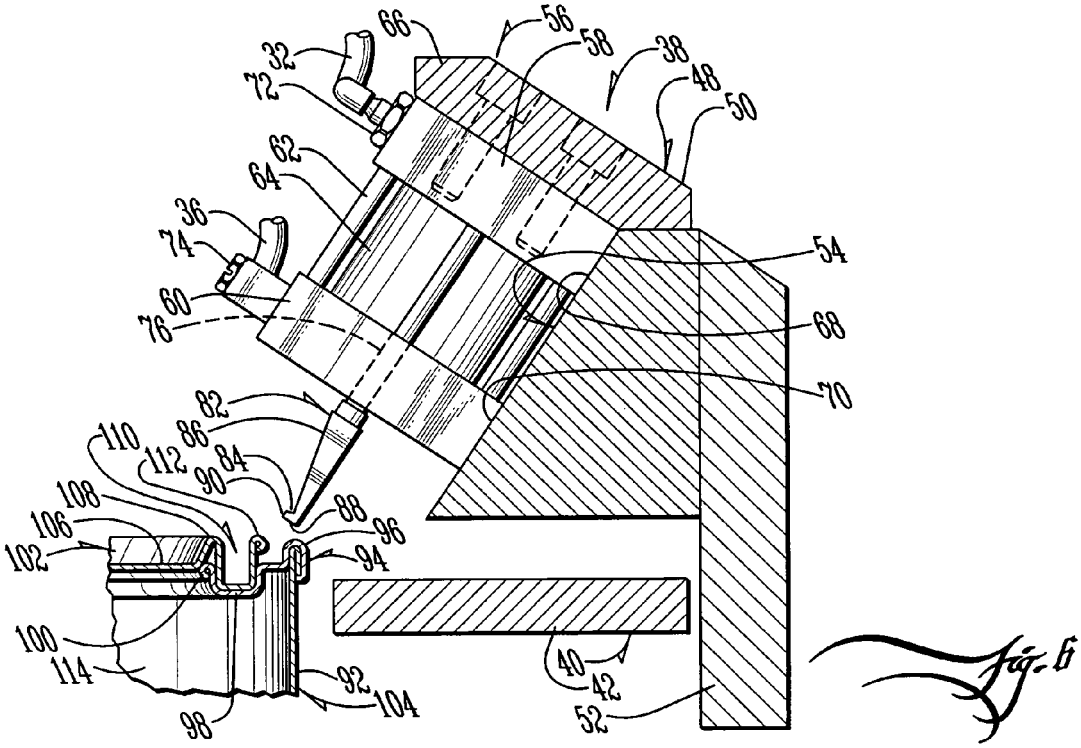
FIG. 6 illustrates a side elevation in cross-section and partial phantom of the bracket assembly, taken along line 6—6 of FIG. 3.

As shown in FIG. 5, each bit slot (54) is sized to accommodate a bit assembly (56), which includes a top slab (58) and a bottom slab (60), secured to one another by a plurality of bolts (62). Secured between the slabs (58) and (60) is a pneumatic actuator (64). Of course, a hydraulic, electric or other suitable linear actuator known in the art may be used. In the preferred embodiment, the pneumatic actuator (64) is a 1.9 centimeter diameter, 1.9 centimeter stroke linear actuator, manufactured by Bimba Manufacturing Company of Monee, Ill. Provided over the bit slot (54) is a steel cap (66), bolted or otherwise secured to the shoulder ring (48). As shown in FIGS. 5–6, the steel cap (66) is provided with a pair of grooves (68) into which the top slab (58) is positioned and maintained. Similarly, near the bottom of the bit slot (54), the shoulder ring (48) is provided with a similar pair of grooves (70) into which the bottom slab (60) is positioned and maintained. These grooves (68) and (70) properly position the bit assembly (56) and prevent inadvertent misalignment of the bit assembly (56) as the pneumatic actuator (64) extends and retracts.

As shown in FIG. 5, the top slab (58) is provided with an inlet coupling (72) and a bottom slab (60) is provided with an outlet coupling (74), such as those well known in the art for coupling pneumatic lines. The inlet coupling (72) is coupled to the first line (32), while the outlet coupling (74) is coupled to the inlet coupling (72) of a second bit assembly (56). The second bit assembly (56) is, in turn, coupled into fluid communication with a third bit assembly (56) and so on until all of the bit assemblies (56) are coupled into fluid communication in series. The outlet coupling (74) of the last bit assembly (56) is coupled to the first exhaust line (36). (FIGS. 5 & 6).

The pneumatic actuator (64) is coupled to a steel shaft (77). As shown in FIG. 5, the steel shaft (77) is coupled to a bit (82). Although in the preferred embodiment the bit (82) is constructed of hardened stainless steel, the bit (82) may be constructed of any suitable material, including but not limited to magnetic or polymer material, or may be designed with a gripping or "pliers type" element (not shown). As shown in FIG. 6, the bit (82) tapers at a twelve degree angle, and is provided on its end with a lip (84) extending more than 0.2 millimeters, and less than 5 millimeters, from the main body (86) of the bit (82). The lip (84) preferably extends more than one millimeter, and less than 3 millimeters, from the main body (86) of the bit (82), and, most preferably, 2 millimeters from the main body (86) of the bit (82). As shown in FIG. 6, in the preferred embodiment of the present invention, the bit (82) tapers inward toward the lip (84) before tapering outward at the lip (84) toward a substantially flat tip (88). The flat tip (88) is preferably wider than the narrowest portion of the bit (82). Alternatively, the bit (82) may taper to a chisel point.

Like the tip (88) of the bit (82), the tip (90) of the lip (84) is also flat, rather than tapering to a chiseled or knife point. In the preferred embodiment, the bit (82) is 3.124 centimeters long, 1.016 centimeters wide, and tapers from 0.889 centimeters at its widest point to 0.178 centimeters at its narrowest point. Of course, the bit (82) may be of any suitable taper or dimensions, and may be provided with a plurality of prongs, rather than as a single prong as shown in the drawings.

As shown in FIG. 6, a standard paint can (104) comprises a sidewall (92) crimped onto a rim (94) to form a rounded edge (96). From the rounded edge (96), the rim (94) extends inward and then downward to form a trough (98). From the trough (98), the rim (94) extends upward to form a curled edge (100), comprising the innermost portion of the rim (94). The lid (102) of the paint can (104) comprises a generally flat center portion (106) provided with a ridge (108) near its perimeter, which initially extends upward before extending downward to form a spline (110). From the spline (110), the lid (102) extends upward and curls under to form a lip (112). As described below, the lip (112) aids in removal of the lid (102) from the container body (114).

Figure 7:
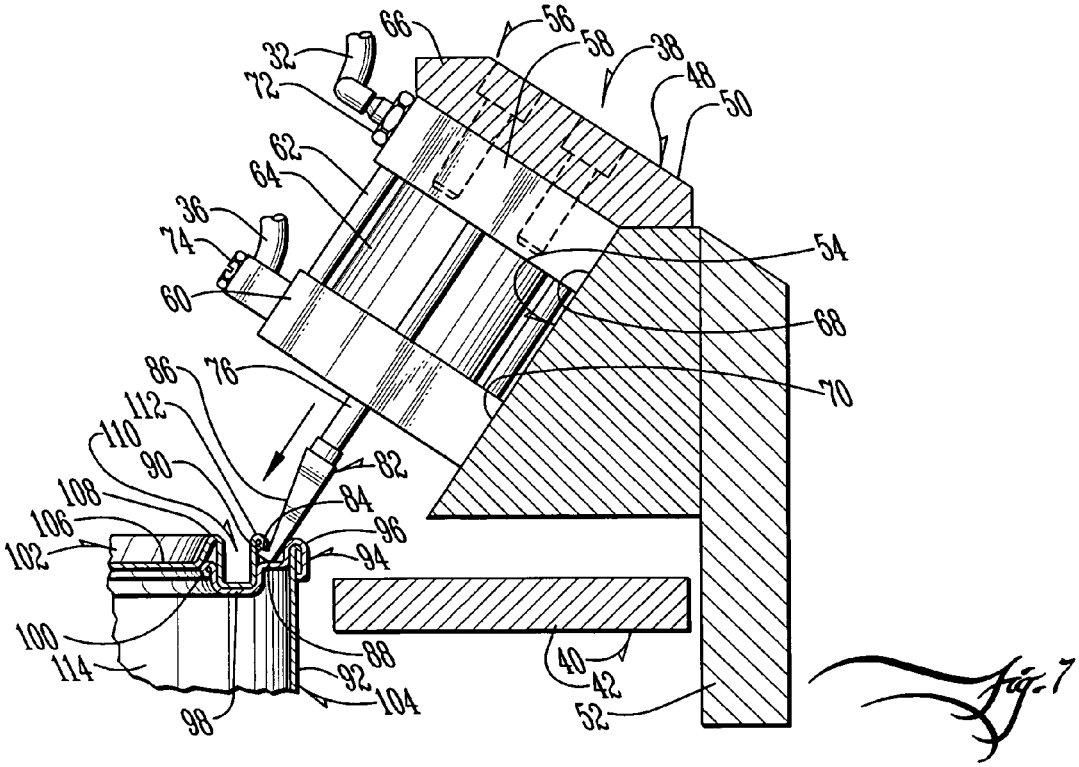
FIG. 7 illustrates the bit assembly of FIG. 6, shown in the extended position with the bit positioned between the lid and the container.

As shown in FIG. 7, the bit assembly (56) is preferably mounted to the shoulder ring (48) in a manner which aligns the bit (82) at angle fifty-six degrees from the plane defined by the top. This orientation allows the tip (88) of the bit (82) to pass between the lip (112) and rim (94) of the paint can flat center portion (106) of the lid (102) of the paint can (104). When the bit (82) is extended by the pneumatic actuator (64), it passes between the rim (94) and the lip (112). Depending on the angle, size and orientation of the tip (90) of the lip (84), the bit assembly (56) can be secured to the shoulder ring (48) in any desired orientation or angle.

Figure 8:
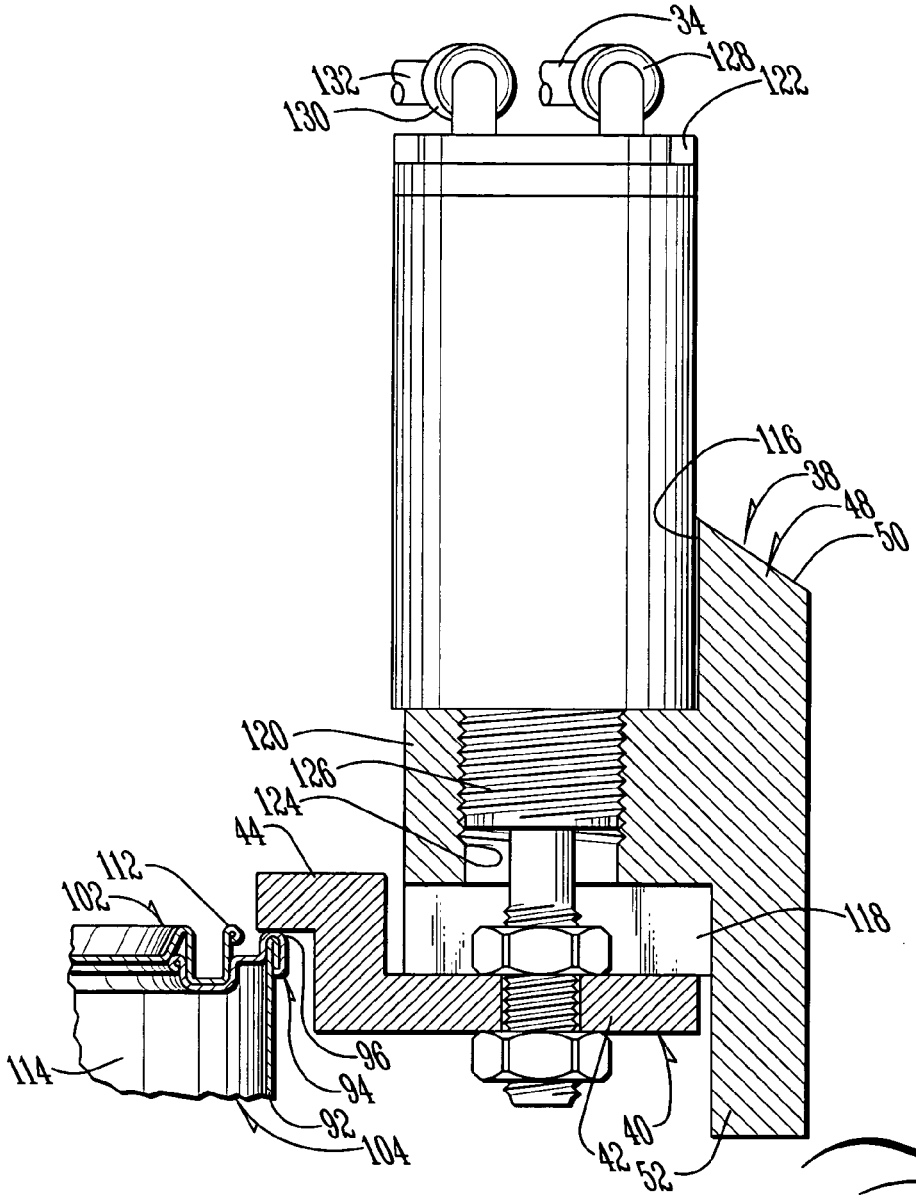
FIG. 8 illustrates a side elevation in cross-section, taken along line 8—8 of FIG. 3.

As shown in FIG. 3, the annular plate (42) of the base plate (40) defines an interior diameter slightly larger than the edge (96) of the paint can (104), while the shoulders (44) of the base plate (40) form an interior diameter slightly smaller than the edge (96) of the paint can (104). As shown in FIG. 8, when the opener (10) is positioned over the paint can (104), the shoulders (44) rest on the edge (96) of the paint can (104). Also as shown in FIG. 8, the shoulders (44) do not extend inward far enough to cover the lip (112) of the lid (102). As shown in FIG. 3, the shoulder assembly (38) is provided with three upper lift slots (116) and three lower lift slots (118), separated by individual lift brackets (120).

Figure 9:
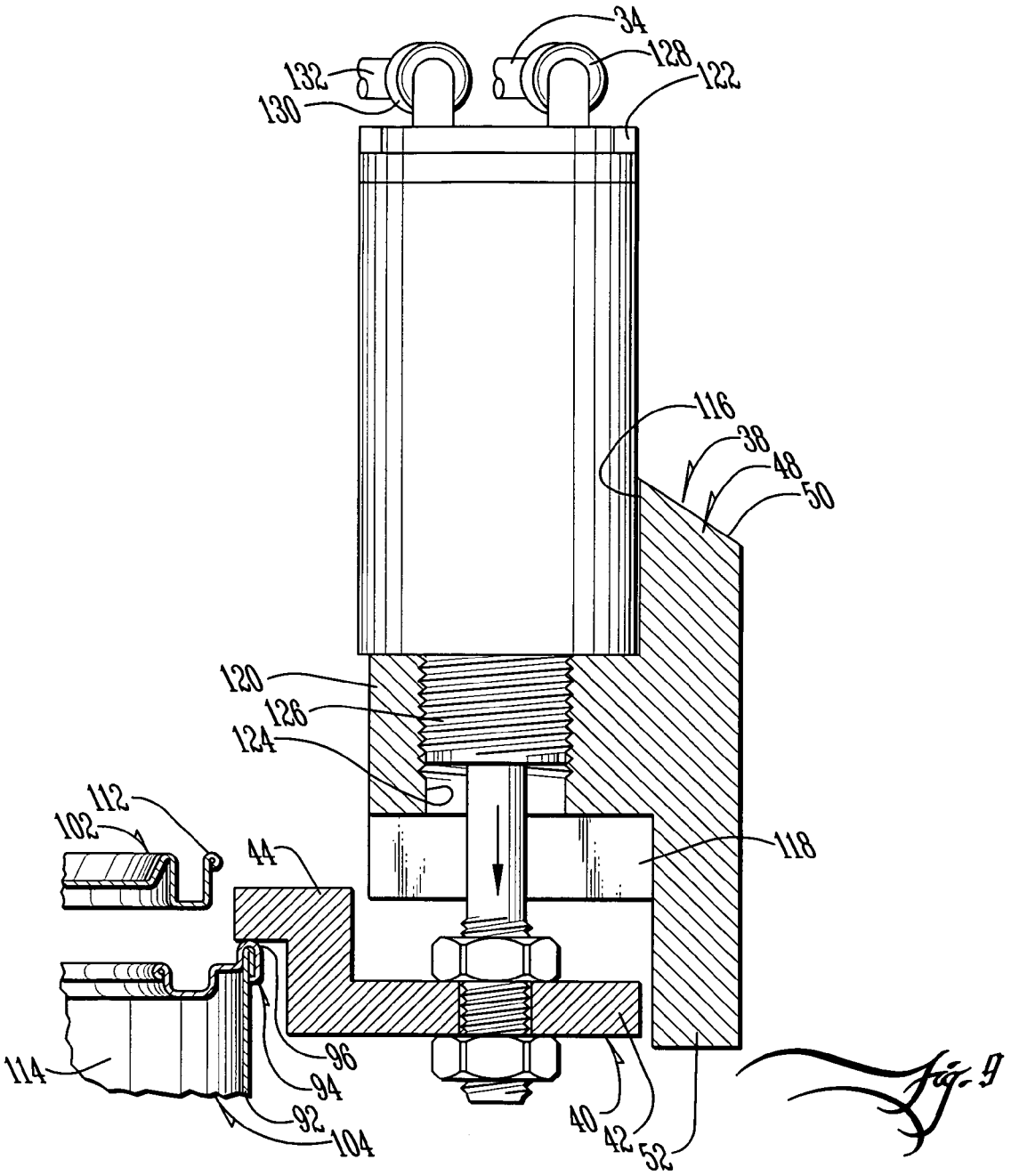
FIG. 9 illustrates the lift actuator of FIG. 8, shown in the extended position.

Although the lift slots (116) and (118) may be of any suitable dimensions, in the preferred embodiment, the lift slots are sized to accommodate a large pneumatic actuator (122). Although the large pneumatic actuator (122) may be of any suitable type known in the art, in the preferred embodiment the large pneumatic actuator (122) is a 3.175 centimeter, 1.9 centimeter stroke, linear actuator, manufactured by Clippard Instrument Laboratory, Inc. of Cincinnatti, Ohio. As shown in FIG. 8, the large pneumatic actuator (122) is secured within the upper lift slot (116) to the lift bracket (120) by bolts or similar securement means. The lift bracket (120) is preferably provided with a throughbore (124) to accommodate the threaded neck (78) and the shaft (126) of the large pneumatic actuator (122). As shown in FIGS. 7–9, the shaft (126) is secured to the annular plate (42) of the base plate (40) by a pair of nuts (80). The large pneumatic actuator (122) is preferably to move the shaft (126) a sufficient distance to lift the lid (102) from the paint can (104) when the tips (88) of the bits (82) have been moved into position under the lip (112) of the lid (102). In the preferred embodiment, this distance is greater than one millimeter and less than 10 centimeters, and, more preferably, greater than one-half centimeter and less than 3 centimeters.

As shown in FIGS. 3 and 8, coupled to the large pneumatic actuator (122), is an inlet coupling (128) coupled to the second line (34). The large pneumatic actuator (122) is also provided with an outlet coupling (130). The outlet coupling (130) of the large pneumatic actuator (122) is coupled to the inlet coupling (128) of a second pneumatic actuator (134). Similarly, this second pneumatic actuator (134) is provided with an outlet coupling (130) coupled to an inlet coupling (128) of a third pneumatic actuator (136). This third pneumatic actuator (136) is also provided with an outlet coupling (130), coupled to the exhaust line (132), thereby coupling all of the pneumatic actuators (122), (134) and (136) into a series orientation with the pressurized air traveling from the control box (14) through each of the large pneumatic actuators (122), (134) and (136), and back to the control box (14).

When it is desired to open a paint can (104) using the opener (10) of the present invention, the shoulder assembly (38) of the opener (10) is positioned over the paint can (104) as shown in FIG. 3, with the shoulders (44) of the base plate (40) resting on the edge (96) of the paint can (104). Thereafter, the first valve (28) is actuated to force air (138) from the air tank (24) through the control box (14), first line (32) and first pneumatic line manifold (134) to the bit assembly (56). (FIGS. 1–3). As shown in FIG. 6, as air moves into the pneumatic actuators (64) of the bit assemblies (56), the shafts (76) extend the bits (82) toward the paint can (104). As shown in FIG. 7, the shafts (76) continue to extend until the lips (84) of the bits (82) are positioned under the lip (112) of the lid (102) of the paint can (104). Once the bits (82) have all been positioned under the lip (112) of the lid (102), the second valve (30) is manually actuated to send air (138) from the air tank (24) through the second line (34) to the large pneumatic actuator (122).

Figure 10:
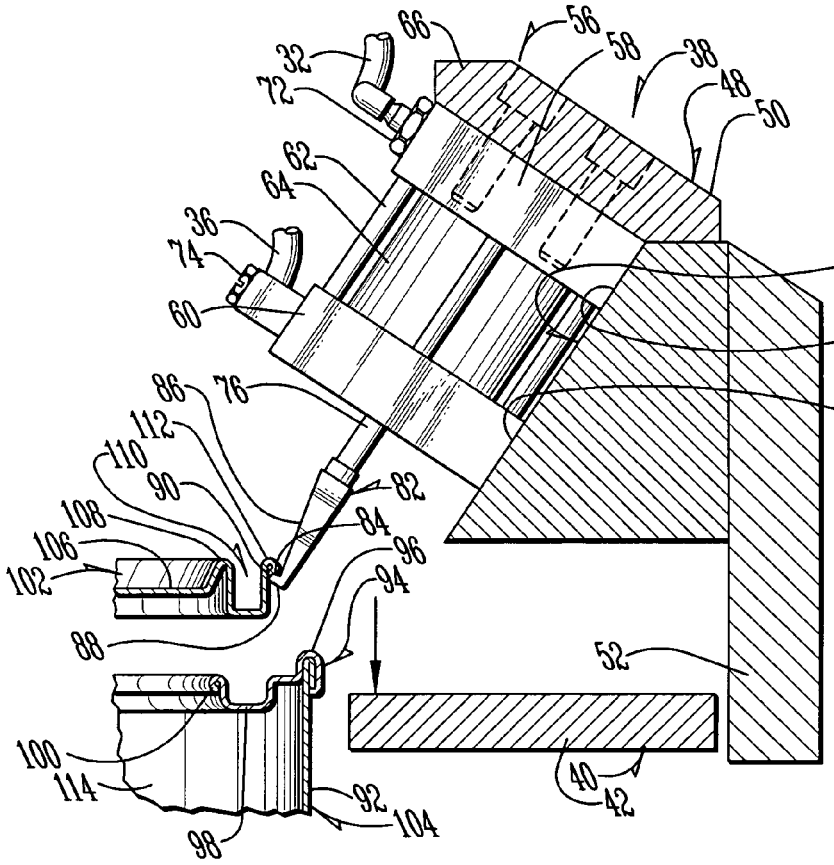
FIG. 10 illustrates the bit assembly of FIG. 7, shown after the lift actuator has been extended.

As shown in FIG. 8, as air (138) enters the large pneumatic actuators (122), the shafts (126) extend from the large pneumatic actuators (122) and push the annular plate (42) away from the shoulder ring (48). The shafts (126) continue to push on the annular plate (42), thereby moving the bits (82) away from the container body (114) of the paint can (104). The faces (140) of the bits (82), which includes any portion of the bits (82) contacting the lid (102), contact and lift the lid (102) until the lid (102) has been removed from the container body (114). As shown in FIGS. 9–10, the shoulders (44) of the base plate (40) maintain the container body (114) in place, while the large pneumatic actuators (122) lift the shoulder ring (48) and the bit assemblies (56) away from the container body (114). As the bit assemblies (56) moves upward relative to the container body (114), the lips (84) or other portion of the faces (140) of the bits (82) catch the lip (112) of the lid (102) of the paint can (104), pulling it upward and away from the container body (114), along with the bit assembly (56).

After the lid (102) has been removed from the container body (114), the lid may be extracted by reaching in through the top of the opener (10). Alternatively, the valves (28) and (30), can be released, thereby causing air (138) to stop entering the pneumatic actuators (64) and large pneumatic actuator (122), and allowing the air (138) contained therein to escape through the exhaust lines (36) and (132). This causes the shafts (76) and (126) to retract back into the pneumatic actuators (64) and large pneumatic actuators (122) respectively, lowering the shoulder ring (48) back onto the base plate (40) while retracting the bits (82). Thereafter, the opener (10) may be removed from the paint can (104) and the lid (102) removed by hand.

By providing the opener with a plurality of bits (82), each pneumatically actuated, the opener (10) of the present invention is capable of opening cans which have been damaged or bent, and is also capable of opening cans where the lid (102) has become thoroughly stuck to the container body (114) by dried adhesive, paint, or other material.

The foregoing description and drawings merely explain and illustrate the invention, and the invention is not limited thereto, except insofar as the claims are so limited, as those skilled in the art who have the disclosure before them will be able to make modifications and variations therein without departing from the scope of the invention. For example, it is anticipated that any desired type of energy may be used to actuate the bits (82) or lift the shoulder ring (48). As an example, hydraulic, electric or mechanical energy may be used. It is further anticipated that the shoulder ring (48) may be of a hinged clamshell design, with the opener (10) securing around a paint can (104) instead of being positioned down onto a paint can (104). It is also anticipated that any suitable number of bits, or large pneumatic actuators, of any desired configuration, may be utilized. It is further anticipated that a plurality of bit may be secured to a single shaft in either a linear or offset pattern to accommodate the curvature of the lid (102) of the paint can (104). It is additionally anticipated that the bits (82) may be provided without lips and actuated to pivot, rather than lift the lid away from the can.

What is claimed is:

1. An opener for removing a lid from a container, said opener comprising:

(a) a first bit, having a face (b) first means coupled to said first bit for moving said face of said first bit into contact with the lid and for moving said first bit relative to the container;

(c) a second bit, having a face;

(d) second means coupled to said second bit for moving said face of said second bit into contact with the lid and for moving said second bit relative to the container;

(e) means for contacting said face of said first bit with the lid; and (f) means for opening the container by moving said first bit relative to the container.

2. The opener of claim 1, wherein said second means comprises:

a. means for contacting said face of said second bit with the lid; and b. means for opening the container by moving said second bit relative to the container.

3. An opener for removing a lid from a container, said opener comprising:

(a) a first bit, have a face;

(b) first means coupled to said first bit for moving said face of said first bit into contact with the lid and for moving said first bit relative to the container;

(c) a second bit, having a face;

(d) second means coupled to said second bit for moving said face of said second bit into contact with the lid and for moving said second bit relative to the container; and (e) wherein said first bit comprises a shank coupled to said face of said first bit.

4. An opener for removing a lid from a container, said opener comprising:

(a) a first bit, having a face;

(b) first means coupled to said first bit for moving said face of said first bit into contact with the lid and for moving said first bit relative to the container wherein said first means comprises:

(i) a linear actuator coupled to said first bit; and (ii) a support bracket pivotally coupled to said linear actuator;

(c) a second bit, having a face; and (d) second means coupled to said second bit for moving said face of said second bit into contact with the lid and for moving said second bit relative to the container.

5. The opener of claim 4, wherein said second means comprises:

a. a supplemental linear actuator coupled to a second bit; and b. a supplemental support bracket pivotally coupled to said linear actuator.

6. The opener of claim 5, wherein said second means comprises means for moving said linear actuator relative to the container.

7. The opener of claim 6, wherein said linear actuator moving means comprises means for moving said supplemental linear actuator relative to the container.

8. The opener of claim 7, wherein said linear actuator moving means comprises means for moving said support bracket.

9. The opener of claim 8, further comprising means for transferring force generated by said linear actuator moving means to the container.

10. The opener of claim 8, further comprising means for transferring a sufficient force from said linear actuator to the container to move the lid relative to the container.

11. An opener for removing a lid from a container, the opener comprising:

a. a first bit;

b. first means for moving said first bit toward the lid;

c. a second bit;

d. second means for moving said second bit toward the lid; and e. third means for moving said first bit and said second bit relative to the container after said first bit and said second bit have moved into contact with the lid.

12. The opener of claim 11, wherein said first means is a first linear actuator and wherein said second means is a second linear actuator.

13. The opener of claim 12, wherein said third means is a linear actuator.

14. The opener of claim 11, further comprising means for transferring force generated by said third means to the container.

15. The opener of claim 11, further comprising means for transferring a sufficient force from said third means to the container to move the lid relative to the container.

16. An opener for removing a lid from a container, the opener comprising:

a. a first bit;

b. a second bit;

c. a third bit;

d. first means for moving said first bit, said second bit and said third bit toward the lid;

e. second means for moving said first bit, said second bit, and said third bit relative to the container after said first bit, said second bit and said third bit have moved into contact with the lid; and f. third means for transferring force generated by said second means to the container.

17. The opener of claim 16, wherein said third means is arcuate in shape.

18. The opener of claim 16, wherein said first means and said second means are pneumatically actuated.

19. The opener of claim 16, wherein said third means comprises an arcuate bracket provided with an outer shoulder sized to contact the container, and defining an interior large enough to allow the passage of the lid into said interior.

* * * * *